US005691599A

United States Patent [19]

Potter

[11] Patent Number: 5,691,599

[45] Date of Patent: Nov. 25, 1997

[54] MULTI-CHROMIC LATERAL FIELD EMISSION DEVICES WITH ASSOCIATED DISPLAYS AND METHODS OF FABRICATION

[75] Inventor: Michael David Potter, Grand Isle, Vt.

[73] Assignee: International Business Machines Corporation, Armonk, N.Y.

[21] Appl. No.: 641,794

[22] Filed: May 2, 1996

Related U.S. Application Data

[63] Continuation of Ser. No. 324,633, Sep. 18, 1994.

[51] Int. Cl.[6] ..... H01J 19/24

[52] U.S. Cl. ..... 313/495; 313/496; 313/309; 313/351; 313/112

[58] Field of Search ..... 313/495, 309, 313/310, 336, 351, 496, 497, 112; 315/169.4; 345/55, 75

[56] References Cited

U.S. PATENT DOCUMENTS

| | | | |
|---|---|---|---|
| 5,103,144 | 4/1992 | Dunham | 315/366 |
| 5,144,191 | 9/1992 | Jones et al. | 313/308 |
| 5,148,079 | 9/1992 | Kado et al. | 313/309 |
| 5,225,820 | 7/1993 | Clerc | 345/55 |
| 5,233,263 | 8/1993 | Cronin et al. | 313/309 |
| 5,281,891 | 1/1994 | Kaneko et al. | 313/309 |
| 5,283,500 | 2/1994 | Kochanski | 315/58 |
| 5,308,439 | 5/1994 | Cronin et al. | 156/656 |
| 5,408,161 | 4/1995 | Kishino et al. | 313/495 |
| 5,448,133 | 9/1995 | Ise | 313/336 X |
| 5,449,970 | 9/1995 | Kumar et al. | 313/495 |

*Primary Examiner*—Ashok Patel
*Attorney, Agent, or Firm*—Heslin & Rothenberg, P.C.

[57] ABSTRACT

Multi-chromic lateral field emission devices ("FEDs") and methods of fabrication are set forth. The multi-chromic FEDs include a phosphor layer disposed substantially perpendicular to an emission surface. Associated with the phosphor layer are multiple emission regions, and associated with each emission region is an emitter and a filter. Operationally, when electrons are transferred from an emitter into the phosphor layer, a light emission is produced from the associated emission region. The associated filter selectively passes desired wavelengths of light. Specific details of the field emission device, an associated display, and fabrication methods are set forth.

8 Claims, 6 Drawing Sheets

MULTI-CHROMIC LATERAL FIELD EMISSION DEVICES WITH ASSOCIATED DISPLAYS AND METHODS OF FABRICATION

This application is a continuation of application Ser. No. 08/324,633 filed Sep. 18, 1994.

TECHNICAL FIELD

This invention relates in general to electronic displays for use in computers and electronic devices. More particularly, the invention relates to a novel multi-chromic display using lateral field emission devices as the display elements.

BACKGROUND OF THE INVENTION

Electronic displays are fundamental to the use of modern computer and electronic equipment. Historically, cathode ray tube ("CRT") based displays have been the primary display choice. CRTs, however, continue to present several-engineering problems when used in electronic devices. The large size and awkward geometrics of CRTs severely limit their ability to be integrated into small electronic devices. Furthermore, CRTs require high power supply voltages and complex analog control electronics. Taken together, these problems severely limit the usefulness of CRTs in miniature electronic devices.

Liquid crystal displays ("LCDs") represent an alternate display technology for use in electronic devices. Although smaller and flatter than CRTs, use of LCDs presents several problems. Production yields of LCD displays remain generally low, making cost of fabrication relatively high. Moreover, LCD displays typically include relatively large "pixels," limiting the level of miniaturization and resolution that can be achieved. Further, the speed of LCD displays is relatively limited, making usefulness in real time video displays troublesome.

Recently, field emission devices ("FEDs") or micro-vacuum tubes have gained popularity as possible alternatives to conventional semiconductor silicon devices. Although typical applications associated with FEDs range from discrete active devices to high density memories, displays represent a key area in which FED technology has significant potential. However, as of this date, no practical, easy to fabricate, low voltage, full color FED display has been disclosed. The present invention is directed towards solving these problems.

DISCLOSURE OF THE INVENTION

The present invention comprises, in a first aspect, a field emission device ("FED") for emitting electromagnetic energy. The FED includes a phosphor structure which has multiple emission regions. The FED also includes multiple emitters which are separately electrically controllable. Further, each emitter is associated with an emission region of the multiple emission regions. Operationally, electrons emitted by each emitter into the phosphor layer cause an electromagnetic emission from an associated emission region.

As an enhancement, an emission region may have a filter associated therewith. A preselected wavelength of electromagnetic energy is thus emitted from the filter when electrons are emitted from the emitter associated with the emission region. Moreover, the FED may include three emission regions, each having a color filter associated therewith. The three color filters may comprise a red, green and blue color filter so as to facilitate emission of primary colors of light from the FED.

In another aspect, the present invention includes a display comprising a plurality of light emitting FEDs organized in a display matrix. A pair of adjacent FEDs within the display may have a shared emitter. Specifically, the shared emitter may have two tips, each tip being disposed at one end of two opposite ends of the shared emitter such that one tip is associated with an emission region of one FED of the pair, and the other tip is associated with an emission region of another FED of the pair.

The present invention facilitates fabrication of a multi-chromic FED and an associated display, each having significant advantages. The multi-chromic FED overcomes previous limitations of light emitting field emission devices. In particular, minimum gap and direct injection techniques lower the required operating voltages of the device. Further, fabrication of a multi-chromic device capable of producing light of any visible color is facilitated.

The present FED as applied to an associated display has significant advantages over prior display technologies. Specifically, the "speed" of FED display devices is limited primarily by the "speed" of the phosphor used, however, phosphors are currently available that provide light-dark switching times at rates far in excess of human perception. Thus, a "real-time" display is achieved. Further, extremely small displays with very high resolution are possible. As an example, if the size of each multi-chromic FED is approximately 4 microns, a full color display with a resolution of 5,000 pixels by 5,000 pixels may be formed on a square chip 2 cm on each side. This is approximately the resolution of the human eye including peripheral vision. Thus, if two such chips are mounted in an appropriate fixture (a helmet, mask, pair of glasses, etc.), a high-resolution fully immersive virtual reality display device is facilitated.

Thus, the multi-chromic FED and associated display of the present invention represent a significant advancement in the state of the art of microelectronic display elements and associated displays.

BRIEF DESCRIPTION OF THE DRAWINGS

The subject matter which is regarded as the present invention is particularly pointed out and distinctly claimed in the concluding portion of the Specification. The invention, however, both as to organization and method of practice, together with the further objects and advantages thereof, may best be understood by reference to the following detailed description taken in conjunction with the accompanying drawings in which:

BEST MODE FOR CARRYING OUT THE INVENTION

Figure 1:
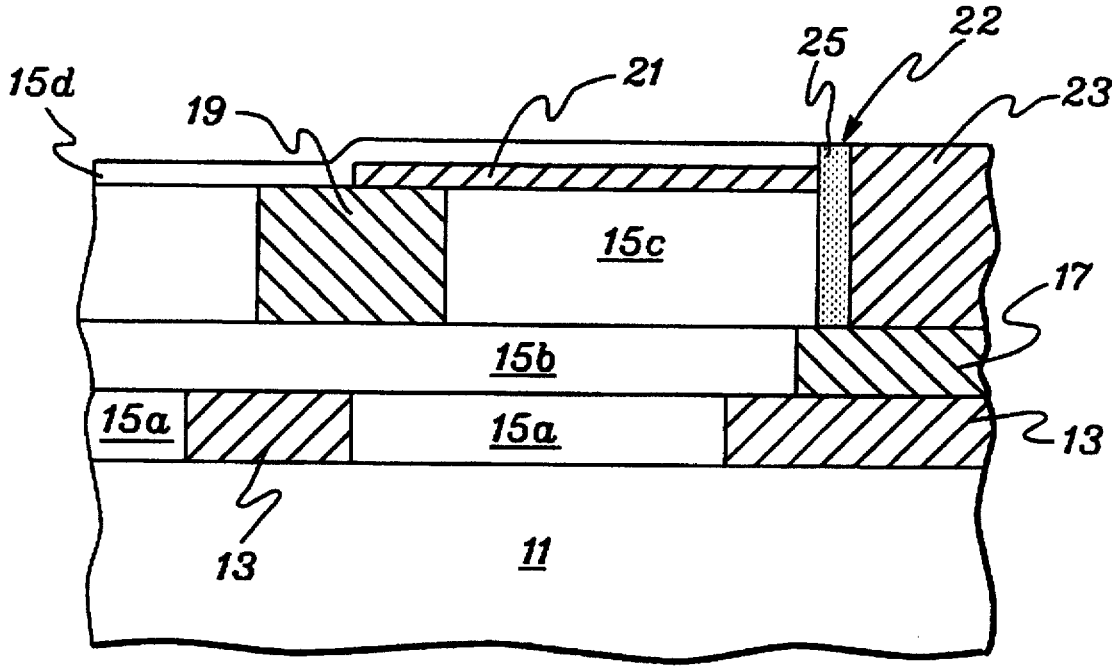
FIG. 1 is a cross-sectional view of a light emitting FED having a lateral emitter according to an embodiment of the present invention.

Certain preferred embodiments of multi-chromic field emission devices, displays formed from the same, and associated methods of fabrication are presented herein. FIG. 1 is a partial cross-sectional view of a light emitting FED including a lateral emitter. Various methods for forming FEDs having lateral emitters may be found in, for example, U.S. Pat. No. 5,233,263 entitled "Lateral Field Emission Devices," issued Aug. 3, 1993, and U.S. Pat. No. 5,308,439 entitled "Lateral Field Emission Devices and Methods of Fabrication," issued May 3, 1994. One method of fabricating the FED of FIG. 1 is described in co-pending U.S. patent application entitled "Lateral Field Emission Devices For Display Elements And Methods Of Fabrication," filed on Oct. 28, 1994, assigned Ser. No. 08/331,307, and hereby incorporated herein by reference. Although described therein in detail, the method will be briefly summarized below.

Substrate 11 of the FED of FIG. 1 can comprise any glass, metal, ceramic, etc., capable of withstanding the elevated temperatures (e.g., 450° C.) typically encountered during the device fabrication processes described below. Fabrication begins with the formation of first metallization layer 13 on substrate 11 using standard damascene processing. By way of example, insulating layer 15*a* comprising an oxide is deposited on substrate 11. Grooves for metallization are next patterned and etched within the insulating layer. A blanket chemical vapor deposition ("CVD") of a conductor, such as, for example, tungsten, fills the etched grooves to form first metallization layer 13. The assembly is then planarized so that the tungsten resides only in the patterned oxide grooves.

The next layer comprising insulator 15*b* and anode stud 17 is formed, again using standard damascene processing. Stud 17 is located so as to later become a base contact for the anode. Thus, electrical connectivity to the later-formed anode is facilitated through the first metallization layer which is in direct electrical and mechanical contact with the stud. Optionally, the anode stud may be omitted and electrical contact to the anode may be made directly from the first metallization layer.

Next, insulating layer 15*c* and second metallization layer 19 are formed above the previous layer. It should be noted that structures 25 and 23 have not yet been fabricated at this point in the process. Emitter 21 is then fabricated, to be in electrical contact with second metallization layer 19. Thin insulation layer 15*d* is formed above the emitter for protection. A hole is etched through insulating layer 15*d*, emitter 21 and insulating layer 15*c* down to buried anode stud 17. Again, this etch is performed through emitter 21, which produces an emitter tip automatically aligned with the anode opening and hence the later formed anode. A phosphor structure comprising phosphor layer 25 is then deposited on the vertical sidewalls of the hole by standard processes. As a general note, the bottom of the hole must be kept clean so that the later formed anode may electrically contact stud 17. Metal comprising anode 23 is next deposited within the hole, so as to fill it. Thus, a columnar-shaped anode is formed with a phosphor layer adjacent to its lateral surfaces. As will be discussed later, in one embodiment of the present invention, the anode is formed in a triangular prismatic shape (see, for example, the top view of FIG. 1*a*).

Operationally, when a voltage potential of sufficient magnitude is applied between the emitter and the anode, electrons are directly injected from the emitter into the phosphor layer, towards the anode. Because emitter 21 comprises a thin-film metallization layer, the radius of curvature across the tip of the emitter is small enough to create the high electric field necessary for operation of the FED. Due to the direct contact of the emitter tip to the phosphor layer, phosphor layer 25 must comprise an insulative-type phosphor, for example, $Z_nS_iO_4:M_n$. The continuous phosphor layer, upon application of a sufficient voltage potential, will glow emitting light at an upper emission surface 22.

Figure 3:
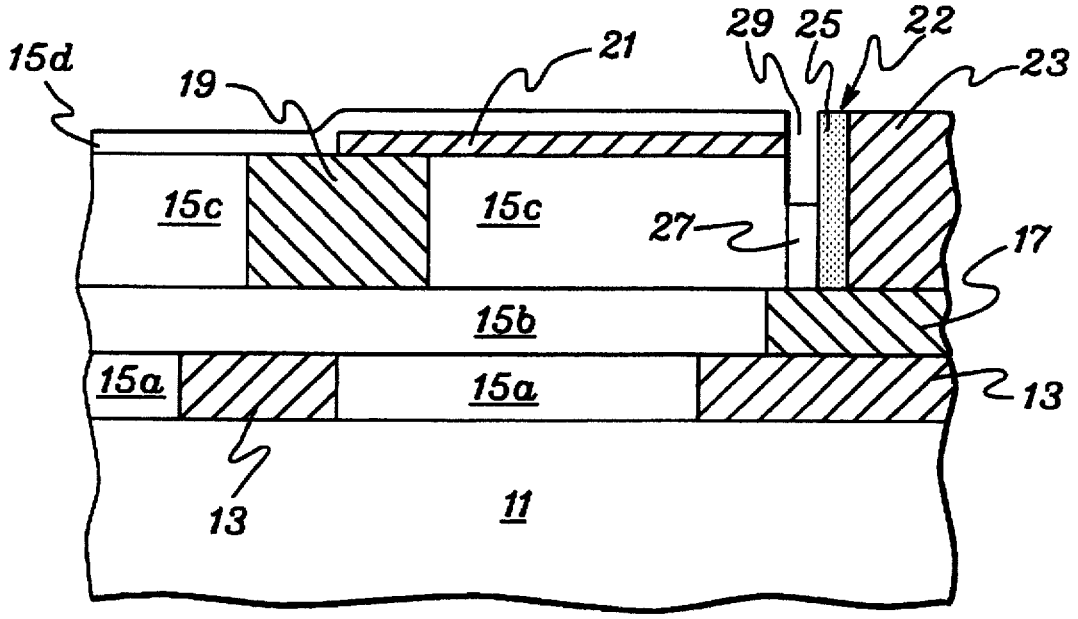
FIG. 3 is an alternate embodiment of a light emitting FED using minimum gap electron injection techniques in conformance with an embodiment of the present invention.

In an alternate embodiment of the present invention (shown in FIGS. 3 and 3*a*), conductive phosphors may be used. Such an embodiment can be fabricated as follows. After the anode hole is etched, and before the phosphor layer is deposited, a sacrificial insulating layer 27 is deposited within the hole. Processing then continues as before (FIGS. 1 and 1*a*) with the forming of both phosphor layer 25 and anode 23. Thereafter, a portion of sacrificial insulating layer 27 may be removed to create a gap between the emitter tip and the phosphor layer. Optionally, the sacrificial insulating layer may be left intact. The thickness of sacrificial insulating layer 27, which corresponds to the distance between the emitter tip and the phosphor layer, is preferably less than the mean free path distance of an electron in air. Thus, if there is air within "minimum gap" 29, the "minimum gap" becomes a virtual vacuum because there is a reduced likelihood of an electron encountering an air molecule as it passes from the emitter to the phosphor layer. This FED may therefore be used in an environment in which evacuation or an inert gas atmosphere is unnecessary.

The basic structure described hereinabove can be used pursuant to the present invention to form a tri-chromic FED for use in a display matrix. With such a use, color generating means are preferably provided within each FED (i.e., display element). As shown in FIGS. 2, 2*a*, and 4, 4*a*, insulating layer 15*e* is formed above emission surface 22, and planarized. Thereafter, filter 31 is formed within the insulation layer, above the "emission region" defined by emitter 21 and continuous phosphor layer 25. The filter is formed within insulating layer 15*e* using a combination of process steps of which each individual step is known in the art. For example, an opening is etched within the insulating layer, followed by spin deposition of filter material into the opening. Thereafter, a planarization process removes all excess filter material other than that contained within the etched hole. Each filter is preferably specifically designed to allow only a predetermined wavelength or combination of wavelengths of light through. Of course, when energized, continuous phosphor layer 25 must emit the desired wavelength of light for transmission through the filter. For example, if a blue color of light is desired, a blue filter (31) is used in conjunction with a phosphor layer which generates light wavelengths in the blue region (other colors of light may also be generated, but are blocked by the blue filter).

The techniques of the present invention may be extended to form an FED capable of emitting multiple colors of light.

Figure 1A:
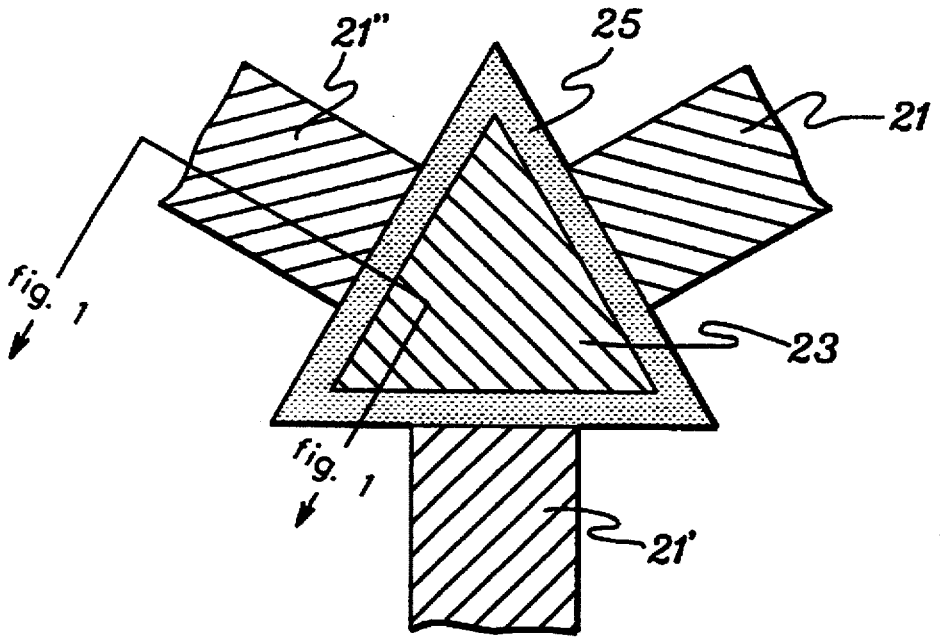
FIG. 1*a* is a top schematic view of the FED of FIG. 1 pursuant to an embodiment of the present invention having three emission regions.
Figure 3A:
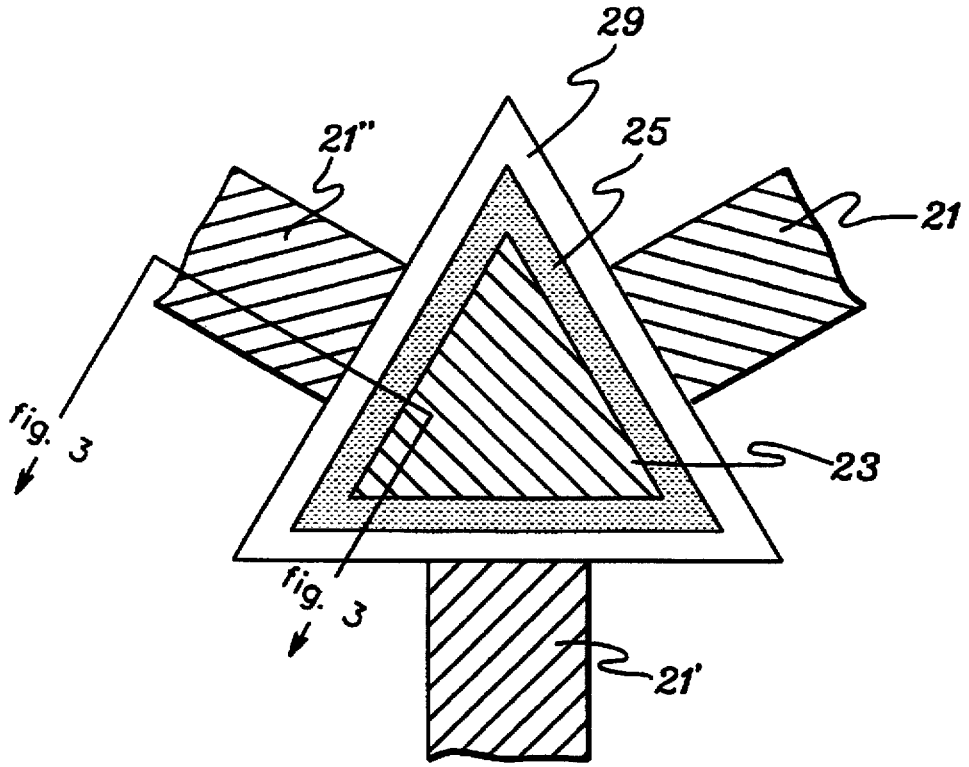
FIG. 3*a* is a top schematic view of the FED of FIG. 3 pursuant to an embodiment of the present invention having three emission regions.

FIGS. 1*a* and 3*a* depict top schematic views of FEDs with three lateral emitters and three corresponding emission regions prior to filter formation. Anode 23 is formed as a triangular prism of which the triangular-shaped end surface of the anode is shown. This shape facilitates formation of an FED with three emission regions, each emission region corresponding to the lateral surface of the triangular prism. Thus, each emission region also corresponds to each edge surface of the triangular phosphor region shown in FIGS. 1*a* and 3*a*. In forming the FED of FIG. 1*a*, the structure shown in FIG. 1 is replicated thrice around triangular anode 23. Specifically, all three emission structures are fabricated simultaneously by using common mask and etch processes. By way of illustration, reference should be made to the sectional line indicating the orientation of the structure of FIG. 1 with respect to FIG. 1*a*.

Phosphor layer 25 is preferably continuous, and disposed adjacent to the lateral surfaces of the anode. As a result, a triangular-shaped phosphor region is formed flush with the top surface (i.e., emission surface 22, FIG. 1) of the FED and the triangular-shaped end of the anode. The three emitters, 21, 21' and 21" each directly contact the phosphor layer. Therefore, in this embodiment a "direct injection" of electrons into the phosphor layer towards the anode is achieved, which means that a non-conductive phosphor material must be used. In an alternate embodiment such as that of FIGS. 3–4*a*, minimal gap techniques may be used in conjunction with a conductive phosphor layer. In either the "direct injection" or "minimum gap" case, three emission regions are defined on the emission surface. Each emission region corresponds to one edge of the triangular phosphor region on the emission surface, which also corresponds to one lateral surface of the anode.

Figure 2:
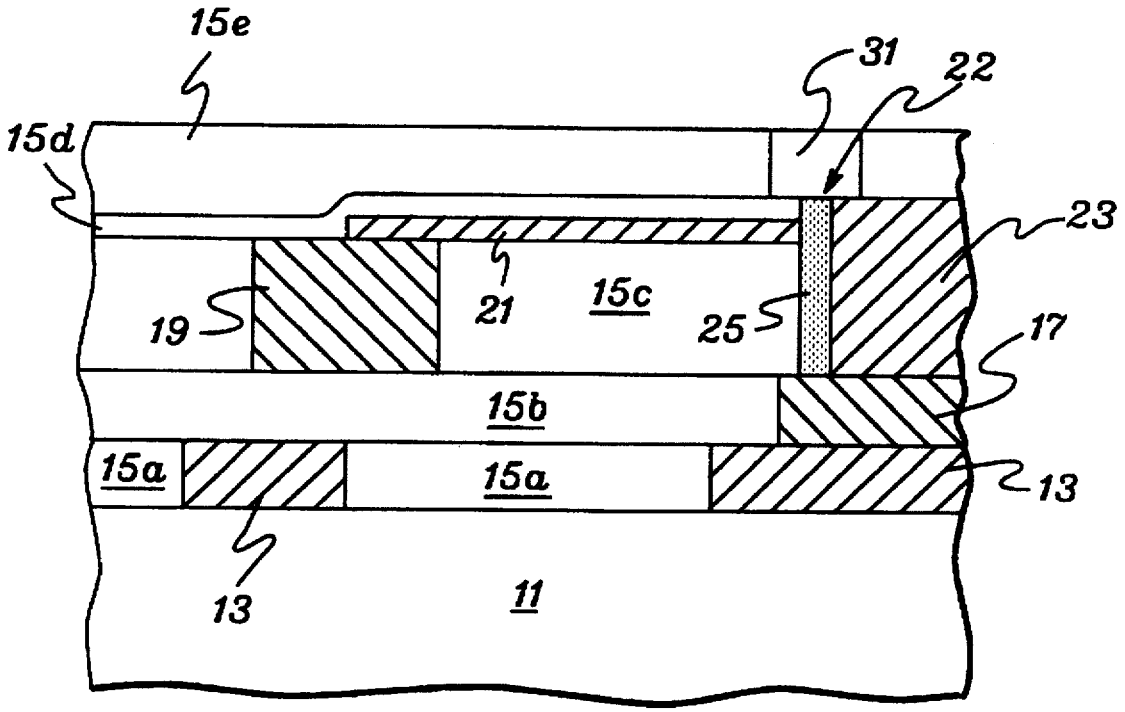
FIG. 2 is a cross-sectional view of the FED of FIG. 1 subsequent to the formation of a filter above the emission surface according to one embodiment of the present invention.
Figure 2A:
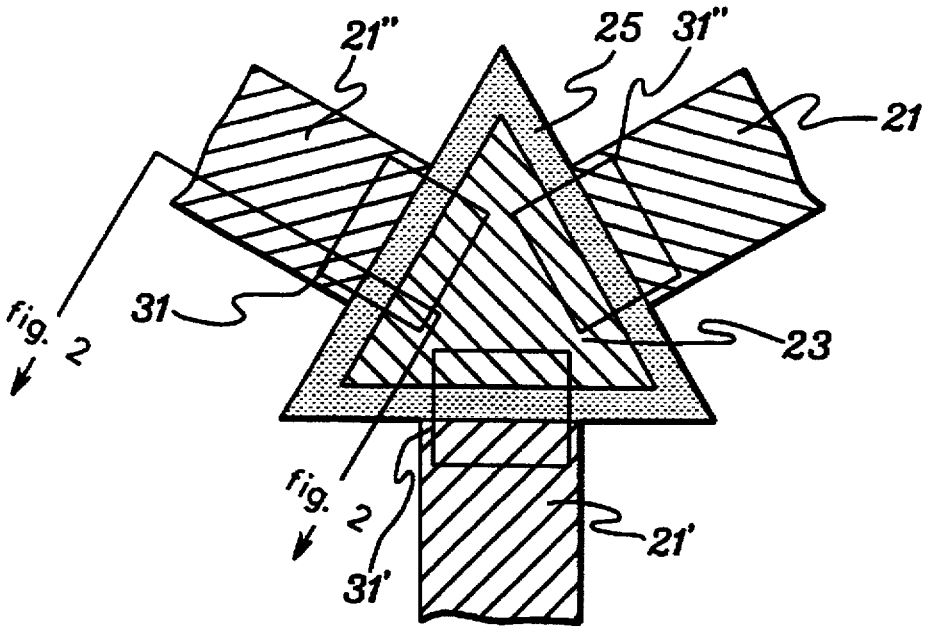
FIG. 2*a* is a top schematic view of the FED of FIG. 2 according to an embodiment of the present invention having three filters.
Figure 4:
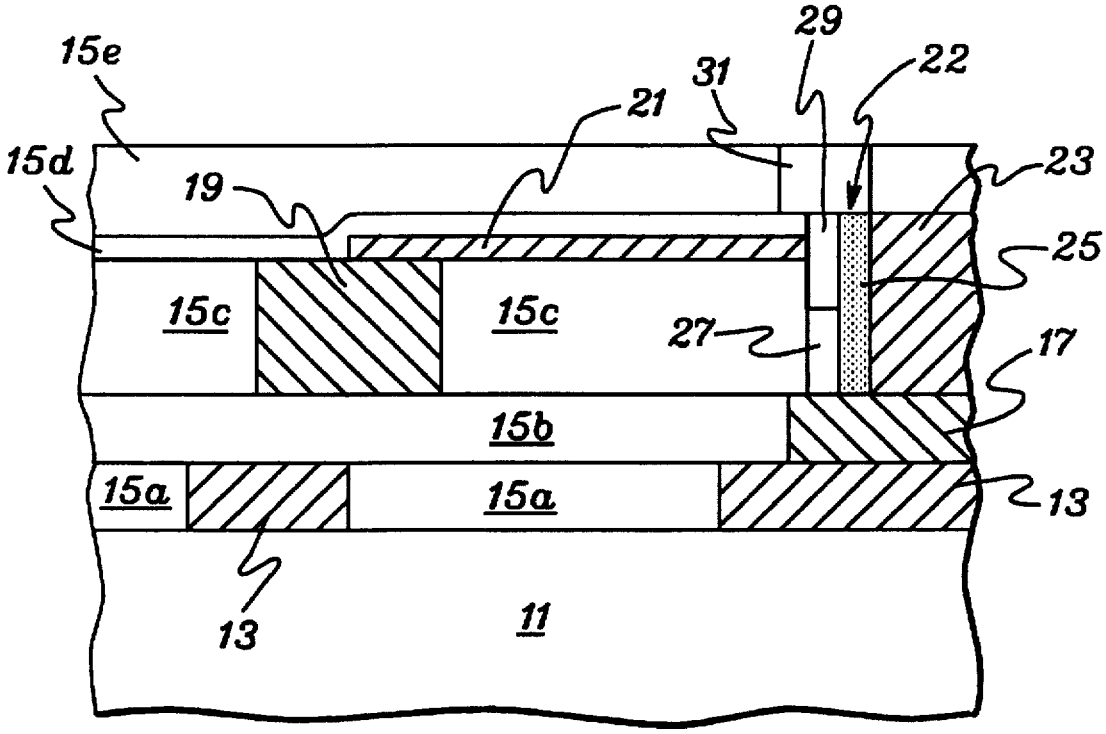
FIG. 4 is a cross-sectional view of the FED of FIG. 3 subsequent to the formation of a filter above the emission surface according to one embodiment of the present invention.
Figure 4A:
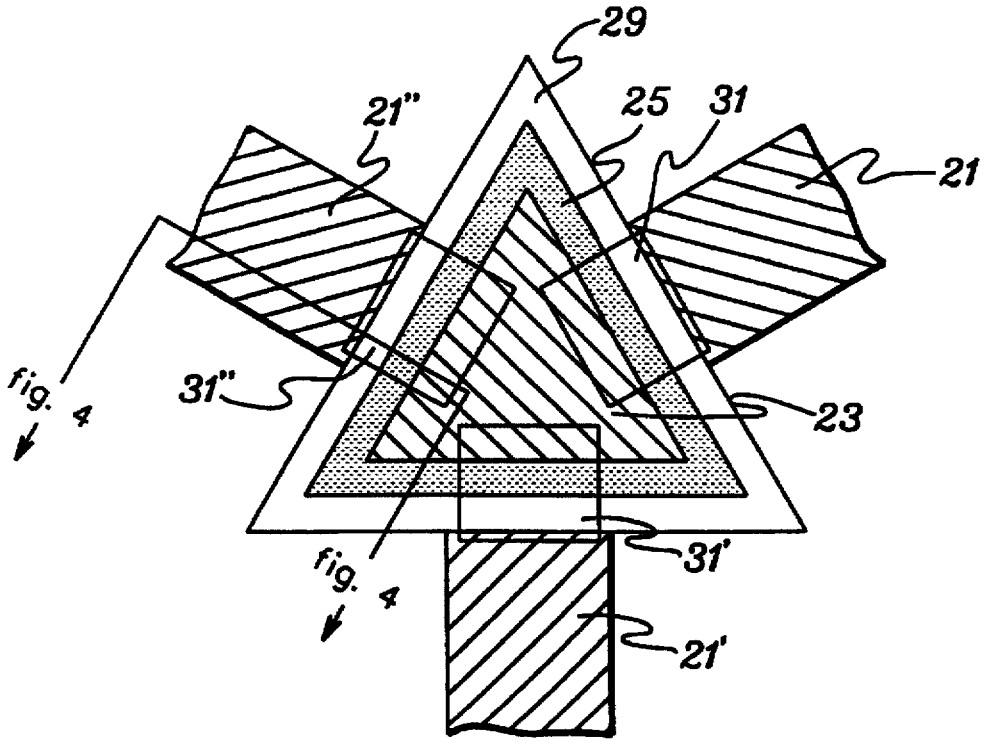
FIG. 4*a* is a top schematic view of the FED of FIG. 4 according to an embodiment of the present invention having three filters.

As previously discussed, a filter may be disposed above the emission region of a FED to allow only certain wavelengths of light to be emitted from the emission region. The same general principle is applicable to FEDs having three emission regions each with its own filter so as to form a FED capable of tri-chromic emissions (FIGS. 2*a* and 4*a*). If primary colors are desired, i.e., red, green and blue, then a tri-chromic display with primary color capability is produced. For example, filters 31, 31' and 31" may comprise red, green and blue filters, respectively. In such a case, it should generally be noted that phosphor layer 25 should comprise a phosphor with a broad-band emission of wavelengths of light which includes all desired colors. One example of such a broad-band phosphor is zinc oxide—ZnO. During operation, by appropriately controlling the intensities of the three available colors, the entire visible spectrum of color may be produced. Such color combination and control techniques will be apparent to one of ordinary skill in the art and are not discussed further herein.

The process used to create three different filters, each associated with one of three emission regions of a FED, involves a modification of the process described above for creating a single filter. Namely, for each of the three filters, the process includes etching a hole in insulating layer **15*e* over the designated emission region. Filter material is then spin deposited, filling the hole. Next, the surface of insulating layer 15*e*** is cleared of excess filter material. Thus, after performing the above-described process three times, three filters are created.

As an extension of the tri-chromic FED disclosed herein, a novel display comprising a "display matrix" of tri-chromic FEDs (FIG. 5) can be constructed. Each FED comprises a "pixel" of the display, and each pixel is capable of producing any visible color. Each FED/pixel actually comprises three pixels, i.e., red, green and blue, but the eye combines these to form a single full-color pixel. By appropriately activating combinations of FEDs in the display, images may be formed. Various techniques for controlling color displays will be apparent to one of ordinary skill in the art and are not discussed further herein.

Figure 5:
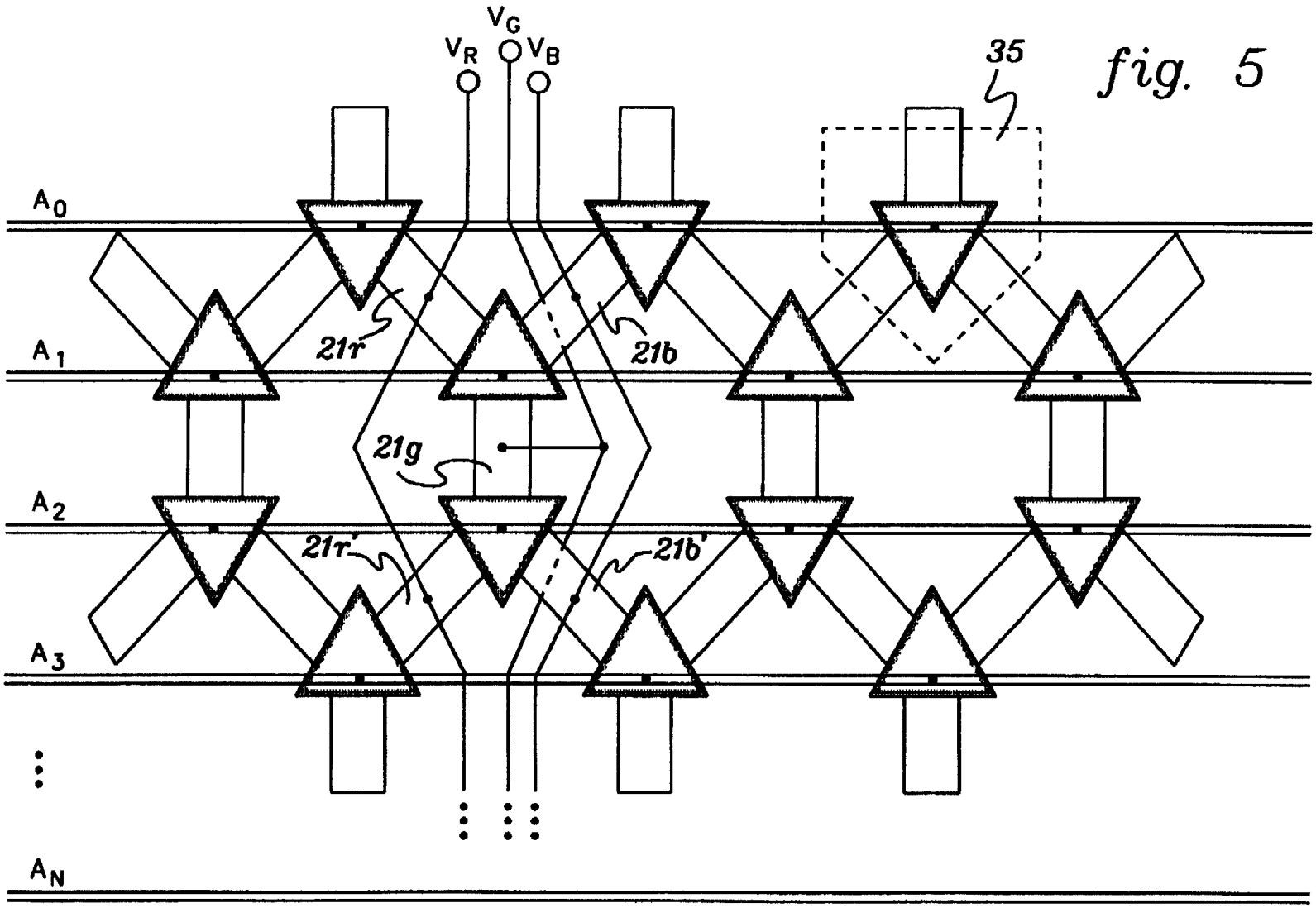
FIG. 5 is a top schematic view of a display comprising the tri-chromic FEDs of the present invention.

The triangular geometry of the tri-chromic FEDs of the display shown in FIG. 5 facilitates a convenient manner of interconnection. As shown, a separate row address line ($A_0 \ldots A_N$) is provided for each row of FEDs. Specifically, each row address line electrically connects to the anode of each FED in a particular row. The address line may comprise, for example, the first metallization layer (first metallization layer 13, FIG. 1) of each FED. Thus, row address lines electrically interconnecting the FEDs may be formed simultaneously with the base layers of each FED, i.e., each of the FEDs of the display can be formed by common mask and etch processes on a single substrate.

Connection to the FED's emitters is also necessary to facilitate addressing and operation of the display. The triangular FED structure of the present invention facilitates a very efficient emitter interconnect scheme. As shown in the expanded view of FIG. 5*a*, emitters are shared by pairs of FEDs, e.g., emitters **21*r*, 21*g* and 21*b*. During fabrication, the thin-film emitters are deposited and patterned such that shared emitters result. As an example, shared emitter 21*r* has two tips, each at an opposite end of the emitter. One tip is associated with an emission region of FED 35*a*, while the other tip is associated with an emission region of FED 35*b***. Thus, when a voltage potential of sufficient magnitude is created between a shared emitter and one (or both) of the associated anodes, electrons are transferred to the corresponding phosphor layer(s) resulting in light emission.

Figure 5A:
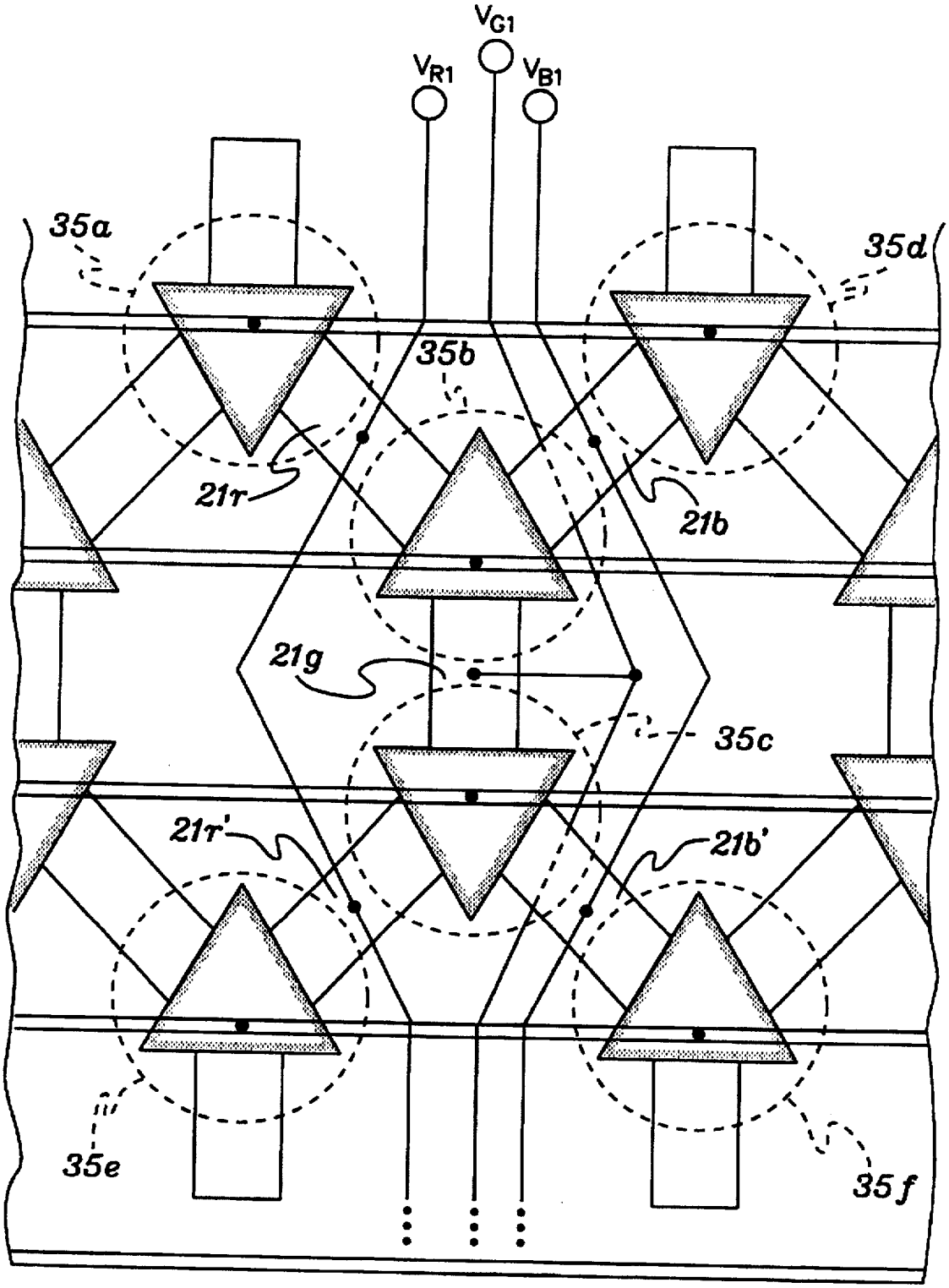
FIG. 5*a* is an expanded view of the display of FIG. 5.

The "shared emitter" feature of the present invention facilitates improved addressing of the display. Again, each shared emitter corresponds to two emission regions. Identical filters can be associated with each of the two emission regions such that the shared emitter can correspond to the same color on each of two adjacent FEDs. For example, as shown in FIG. 5*a*, shared emitter **21*r* corresponds to emission regions associated with FED 35*a* and FED 35*b*. Accordingly, a red filter may be associated with the emission region corresponding to shared emitter 21*r*** on each of the two FEDs.

In order to further facilitate addressing, various shared emitters can be interconnected in a manner as described hereinbelow. Each combination of two adjacent FEDs, adjacency being in any direction, and a shared emitter associated therewith is referred to herein as an "FED pair." For example, with respect to FIG. 5*a*, one adjacent FED pair comprises FED **35*a*, FED 35*b* and shared emitter 21*r*, while another FED pair comprises FED 35*e*, FED 35*c* and shared emitter 21*r'*. Note that the emission regions associated with shared emitter 21*r'*** may also have red filters associated therewith.

These two "FED pairs" have their shared emitters **21*r* and 21*r'*** electrically interconnected by column a address line Vr. Thus, by applying a voltage potential between column address line Vr and a selected row address line, a particular red "dot" is displayed. It is also important to note that although the red "pixels" addressed by the Vr line are not oriented precisely vertically, the eye will not perceive this offset due to the high density of the display. The filters associated with the other shared emitters are selected such that, for example, column address line Vg addresses a column of green pixels, and column address line Vb addresses a column of blue pixels. Although not shown, similar Vr, Vg and Vb lines can be disposed across the entire display, thereby providing full addressability.

Lines Vr, Vg and Vb are provided by various metallization layers within the FED structures. For example, the Vr and Vb lines may be formed entirely from second metallization layer 19 (FIG. 1). Line Vg may be formed from both the first and second metallization layers. This might be necessary in order to "route around" other metallized lines such as the Vr, Vb and row address lines. Vias are provided between the first and second metallization layers to interconnect portions of the Vg lines disposed on the two metal layers.

As a general note, the techniques of the present invention described hereinabove have been applied to a tri-chromic FED with a triangular geometry. Variations on this design are possible. In particular, other anode geometries may be used to facilitate various numbers of emission regions (e.g., a hexagonal prismatic anode could have six emission regions). Accordingly, geometries which permit mono-chromic, bi-chromic, quad-chromic or displays with any other number of colors are possible using the techniques of the present invention. Further, selection of color filters is not limited to the primary colors. For example, in photographic applications, the negative primaries (cyan, magenta and yellow) may be used.

To summarize, the present invention facilitates fabrication of a tri-chromic FED and an associated display, each having significant advantages. The tri-chromic FED overcomes previous limitations of light emitting field emission devices. In particular, minimum gap and direct injection techniques lower the required operating voltages of the device. Further, fabrication of a tri-chromic device capable of producing light of any visible color is set forth.

The present FED as applied to an associated display has significant advantages over prior display technologies. Specifically, the "speed" of the FED display devices is limited primarily by the "speed" of the phosphor used, however, phosphors are currently available that provide light-dark switching times at rites far in excess of human perception. Thus, a "real-time" display is achieved. Further, extremely small displays with very high resolution are possible. As an example, if the size of each multi-chromic FED is approximately 4 microns, a full color display with a resolution of 5,000 pixels by 5,000 pixels may be formed on a square chip 2 cm on each side. This is approximately the resolution of the human eye including peripheral vision. Thus, if two such chips are mounted in an appropriate fixture (a helmet, mask, pair of glasses, etc.), a fully high-resolution immersive virtual reality display device can be produced.

For all of the above reasons, the tri-chromic FED and associated display of the present invention represent a significant advancement in the state of the art of microelectronic display elements and associated displays.

While the invention has been described in detail herein, in accordance with certain preferred embodiments thereof, many modifications and changes therein may be affected by those skilled in the art. Accordingly, it is intended by the appended claims to cover all such modifications and changes as fall within the true spirit and scope of the invention.

What is claimed is:

1. A field emission device ("FED") for emitting electromagnetic energy comprising:

a continuous phosphor layer, said continuous phosphor layer having a plurality of emission regions; and a plurality of lateral emitters, each lateral emitter of said plurality of lateral emitters being separately electrically controllable and extending parallel to an upper surface of a supporting substrate of said FED, and wherein each lateral emitter is associated with a different emission region of said plurality of emission regions, wherein electrons emitted by each lateral emitter into said continuous phosphor layer cause an electromagnetic emission from the associated emission region of said continuous phosphor layer.

2. The FED of claim 1, wherein a selected emission region of said plurality of emission regions of said continuous phosphor layer has a filter associated therewith such that a preselected wavelength of electromagnetic energy is transmitted through said filter when electrons are emitted from the lateral emitter associated with said selected emission region.

3. The FED of claim 2, wherein said plurality of emission regions comprises three emission regions, each emission region of said three emission regions having a different color filter associated therewith such that a first emission region of said three emission regions has a first color filter associated therewith, a second emission region of said three emission regions has a second color filter associated therewith, and a third emission region of said three emission regions has a third color filter associated therewith so as to facilitate tri-chromic emission of light from said FED when electrons are emitted into said plurality of emission regions of said FED.

4. The FED of claim 3, wherein said first color filter comprises a red filter, said second color filter comprises a blue filter, and said third color filter comprises a green filter so as to facilitate emission of primary colors of light from said FED.

5. A display device comprising a plurality of light emitting field emission structures ("LEFESs"), said plurality of LEFESs being organized in a display matrix, each LEFES of said plurality of LEFESs comprising:

a continuous phosphor layer, said continuous phosphor layer having a plurality of emission regions; and a plurality of lateral emitters, each lateral emitter of said plurality of lateral emitters being separately electrically controllable and extending parallel to an upper surface of a supporting substrate of said FED, and wherein each lateral emitter is associated with an emission region of said plurality of emission regions, wherein electrons emitted by each lateral emitter into said continuous phosphor layer cause a light emission from the associated emission region of said continuous phosphor layer.

6. The display device of claim 5, wherein a selected emission region of said plurality of emission regions of at least some LEFESs of said plurality of LEFESs has a filter associated therewith such that a preselected wavelength of electromagnetic energy is emitted from said filter when electrons are emitted from the lateral emitter associated with said selected emission region.

7. The display device of claim 6, wherein said plurality of emission regions of said at least some LEFESs of said plurality of LEFESs comprises three emission regions, each emission region of said three emission regions having a different color filter associated therewith such that a first emission region of said three emission regions has a first color filter associated therewith, a second emission region of said three emission regions has a second color filter associated therewith, and a third emission region of said three emission regions has a third color filter associated therewith so as to facilitate tri-chromic emission of light from each LEFES of said at least some LEFESs.

8. The display device of claim 7, wherein said first color filter comprises a red filter, said second color filter comprises a blue filter, and said third color filter comprises a green filter so as to facilitate emission of primary colors of light from each LEFES of said at least some LEFESs FEDs.

* * * * *